US009623684B2

(12) United States Patent
Herrmann

(10) Patent No.: US 9,623,684 B2
(45) Date of Patent: Apr. 18, 2017

(54) MODULAR MEDIA ROUTING SYSTEM FOR MULTI-FINISHER PRINTERS

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/727,007

(22) Filed: Jun. 1, 2015

(65) Prior Publication Data

US 2016/0347088 A1 Dec. 1, 2016

(51) Int. Cl.
*B41J 13/00* (2006.01)
*B41J 11/00* (2006.01)

(52) U.S. Cl.
CPC ..... *B41J 13/0036* (2013.01); *B41J 11/0015* (2013.01)

(58) Field of Classification Search
None
See application file for complete search history.

(56) References Cited

U.S. PATENT DOCUMENTS 5,439,208 A * 8/1995 Moser ..... B65H 15/00 271/182
2006/0291018 A1* 12/2006 Lang ..... B41J 3/42 358/540
2009/0230616 A1* 9/2009 Hausler ..... B65H 15/00 271/264

* cited by examiner

*Primary Examiner* — Justin Seo
(74) *Attorney, Agent, or Firm* — BudzynFortunato IP Law, LLC

(57) ABSTRACT

A media sheet router moves sheets from a digital printer through the router and selectively to a plurality of finishers at full process speed. A router inlet path is aligned with the printer outlet path. Two router outlet paths are disposed at ninety degrees to the left and right of the router inlet path. The router outlet paths are each aligned with a finisher inlet path or another router. First and second turning elements are each mounted at forty-five degrees to the router inlet path and at ninety degrees to each other. Each turning element directs the sheets in a helical path to the router outlet paths. Transfer belts hold the sheets against each turning element. A bypass transfer moves the sheet to a bypass outlet path aligned with a bypass finisher inlet path. Diverters selectively direct the sheets onto the turning elements or the bypass transfer.

14 Claims, 14 Drawing Sheets

MODULAR MEDIA ROUTING SYSTEM FOR MULTI-FINISHER PRINTERS

INCORPORATION BY REFERENCE

Not applicable.

TECHNICAL FIELD

This invention relates to redirecting media sheets in digital printing machines, and, more particularly, to an apparatus, system, and method for redirecting the printed sheets from a digital printing machine to multiple selected finishers by means of angled elements.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. The apparatus that turns the sheet over is called an inverter.

In printer systems it is desirable to have the option of multiple finishing units. Some have bypass systems but many do not which precludes additional finishing options. Finishing systems can include simple stackers through fully integrated finishing systems with staplers, stitchers or other finishing options. A customer with one printer may wish to sort output to more than one of these finishers even as part of the same job or back to back jobs. This requires that the system be able to sort the outgoing media to the desired finishing equipment. This is not possible with current systems where integrated bypass routes are not available. A diverter and bypass will redirect sheets to a different path, but the new path typically lies directly above or below the process path. In the event that bypass systems are available, the only option is inline which lengthens the system to an unacceptable extent.

Attempting to redirect the media with a rotating or intermittent motion apparatus is limited by inertias of the system. Such a system is not capable of meeting throughput speeds when PPM rates increase or smaller inter copy gaps are required. Such a system cannot redirect media at full process speeds.

Current RAT (Right Angle Transfer) systems change the sheet orientation from SEF Portrait to LEF Landscape or Landscape to Portrait for any system that is at a right angle to the printer process path. LEF is Long Edge Feed, or Landscape. SEF is Short Edge Feed, or Portrait.

FIG. 1 (prior art) shows a state-of-the-art digital printing machine 84. Printer 84 includes a marking engine 86. Printer 84 has an inverter 92 to turn the sheet over for duplex printing. Typically, as the sheet is inverted, the trail edge becomes the lead edge. This construction also tends to limit the speed at which sheets can be conveyed through inverter 92, because the sheet is stopped and reversed and accelerated.

Accordingly, there is a need to provide a media sheet routing system that will allow multiple finishing systems to be attached to a high speed printer.

There is a further need to provide a media sheet routing system of the type described and that will selectively direct media sheets to each of the multiple finishers without a skipped pitch or change in intercopy gap.

There is a yet further need to provide a media sheet routing system of the type described and that will match the high production rate of a digital printing machine.

There is a still further need to provide a media sheet routing system of the type described and that will not change the sheet orientation from SEF to LEF or from LEF to SEF.

There is an additional need to provide a media sheet routing system of the type described and that is mechanically simple and robust, thereby minimizing cost and avoiding the problems associated with the prior art.

SUMMARY

In one aspect, a media sheet router moves media sheets from a digital printer selectively to a plurality of finishers. The router is used in connection with a first finisher and a bypass finisher. A media sheet has a lead edge and a trail edge, and moves in a process direction along a process path. The router comprises a router inlet path for inputting the media sheet into the router. The router inlet path is adapted for alignment with a process outlet path of the printer. A router first outlet path outputs the media sheet from the router. The router first outlet path is disposed generally at ninety degrees to the router inlet path. The router first outlet path is adapted for alignment with a first finisher inlet path.

A first turning element is mounted on a first axis disposed generally at forty-five degrees to the router inlet path. The first turning element has a first entry path adapted for receiving the media sheet from the router inlet path. The first turning element is adapted for receiving the media sheet from the first entry path and directing the media sheet in a helical path around the first turning element and discharging the media sheet to the router first outlet path.

A bypass transfer moves the media sheet away from the first entry path and toward a bypass outlet path. This is to bypass the first turning element. The bypass outlet path is adapted for outputting the media sheet from the router. The bypass outlet path is adapted for alignment with a bypass finisher inlet path.

A secondary diverter selectively directs the media sheet onto either one of the first entry path or the bypass transfer. Hence, the router is adapted for moving the media sheet from the digital printer through the router and selectively to the plurality of finishers at full process speed and while maintaining sheet orientation.

In another aspect, a media sheet router moves media sheets from a digital printer selectively to a plurality of finishers. The router is used in connection with a first finisher, a second finisher, and a bypass finisher. A media sheet has a lead edge and a trail edge, and moves in a process direction along a process path. The router comprises a router inlet path for inputting the media sheet into the router. The router inlet path is adapted for alignment with a process outlet path of the printer. A router first outlet path outputs the media sheet from the router. The router first outlet path is disposed generally at ninety degrees to the router inlet path. The router first outlet path is adapted for alignment with a first finisher inlet path.

A first turning roller is mounted for rotation on a first axis disposed generally at forty-five degrees to the router inlet path. The first turning roller has an outer surface and a circumference. The first turning roller has a first entry path adapted for receiving the media sheet from the router inlet path. The first turning roller is adapted for receiving the media sheet from the first entry path and directing the media sheet in a helical path around the outer surface of the first turning roller and discharging the media sheet to the router first outlet path.

At least one first transfer belt is juxtaposed with the first turning roller outer surface and extends in a helical path partway around the circumference of the first turning roller. The first transfer belt is adapted for moving the media sheet along the first entry path and holding the media sheet against the first turning roller outer surface and moving the media sheet along the router first outlet path.

A router second outlet path outputs the media sheet from the router. The router second outlet path is disposed generally at ninety degrees to the router inlet path. The router second outlet path is generally opposed to the router first outlet path. The router second outlet path is adapted for alignment with a second finisher inlet path.

A second turning roller is mounted for rotation on a second axis disposed generally at forty-five degrees to the router inlet path and generally at ninety degrees to the first axis. The second turning roller has an outer surface and a circumference. The second turning roller has a second entry path adapted for receiving the media sheet from the router inlet path. The second turning roller is adapted for receiving the media sheet from the second entry path and directing the media sheet in a helical path around the outer surface of the second turning roller and discharging the media sheet to the router second outlet path.

At least one second transfer belt is juxtaposed with the second turning roller outer surface and extends in a helical path partway around the circumference of the second turning roller. The second transfer belt is adapted for moving the media sheet along the second entry path and holding the media sheet against the second turning roller outer surface and moving the media sheet along the router second outlet path.

A primary diverter selectively directs the media sheet onto either one of the first entry path or the second entry path.

A bypass transfer moves the media sheet away from the first entry path and toward a bypass outlet path. This is to bypass the first turning element. The bypass outlet path is adapted for outputting the media sheet from the router. The bypass outlet path is adapted for alignment with a bypass finisher inlet path.

A secondary diverter selectively directs the media sheet onto either one of the first entry path or the bypass transfer. Hence, the router is adapted for moving the media sheet from the digital printer through the router and selectively to the plurality of finishers at full process speed and while maintaining sheet orientation.

In yet another aspect, a method is disclosed for routing media sheets from a digital printer to a plurality of finishers. The method is used in connection with a first finisher and a bypass finisher. The method comprises providing a router for routing the media sheets and aligning a process outlet path of the printer with a router inlet path. The media sheet is moved from the process outlet path of the printer into the router inlet path. A router first outlet path is disposed generally at ninety degrees to the router inlet path. The router first outlet path is aligned with a first finisher inlet path.

A first turning element is disposed generally at forty-five degrees to the router inlet path. The media sheet is received from the router inlet path. The media sheet is directed in a helical path around the first turning element and to the router first outlet path when the first finisher is selected. The media sheet is discharged from the router along the router first outlet path. The media sheet is moved into the first finisher inlet path.

A bypass is provided around the first turning element to a router bypass outlet path. The router bypass outlet path is aligned with a bypass finisher inlet path. The media sheet is received from the router inlet path and directed to the router bypass outlet path when the bypass is selected. The media sheet is moved from the router bypass outlet path into the bypass finisher inlet path. Thus, the media sheet is moved from the digital printer through the router and selectively to the plurality of finishers at full process speed and while maintaining sheet orientation.

These and other aspects, objectives, features, and advantages of the disclosed technologies will become apparent from the following detailed description of illustrative embodiments thereof, which is to be read in connection with the accompanying drawings.

DETAILED DESCRIPTION

Describing now in further detail these exemplary embodiments with reference to the Figures as described above, the media sheet router is typically used in a select location or locations of the paper path or paths of various conventional media handling assemblies. Thus, only portions of exemplary media handling assemblies are illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" (LE) of a media substrate refers to an edge of the sheet that is furthest downstream in the process direction. The "trailing edge" or "trail edge" (TE) of a media substrate refers to an edge of the sheet that is furthest upstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction or process path is a flow stream along which the sheet moves during the process. The process path lies along a plane upon which the media sheet moves. When process paths are aligned, the planes are also generally aligned.

Figure 1:
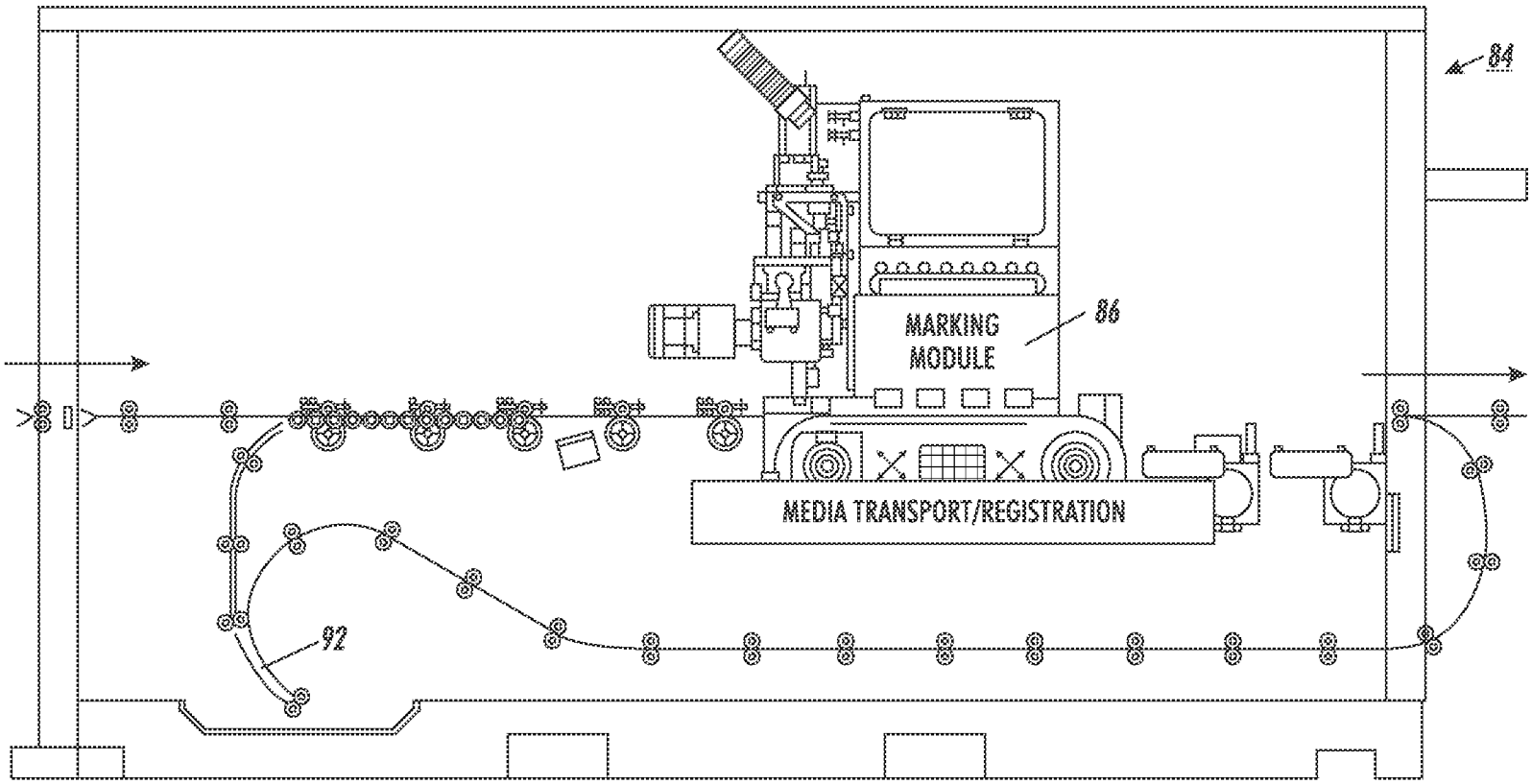
FIG. 1 is a schematic side elevational, sectional view of an exemplary production printer.
Figure 2:
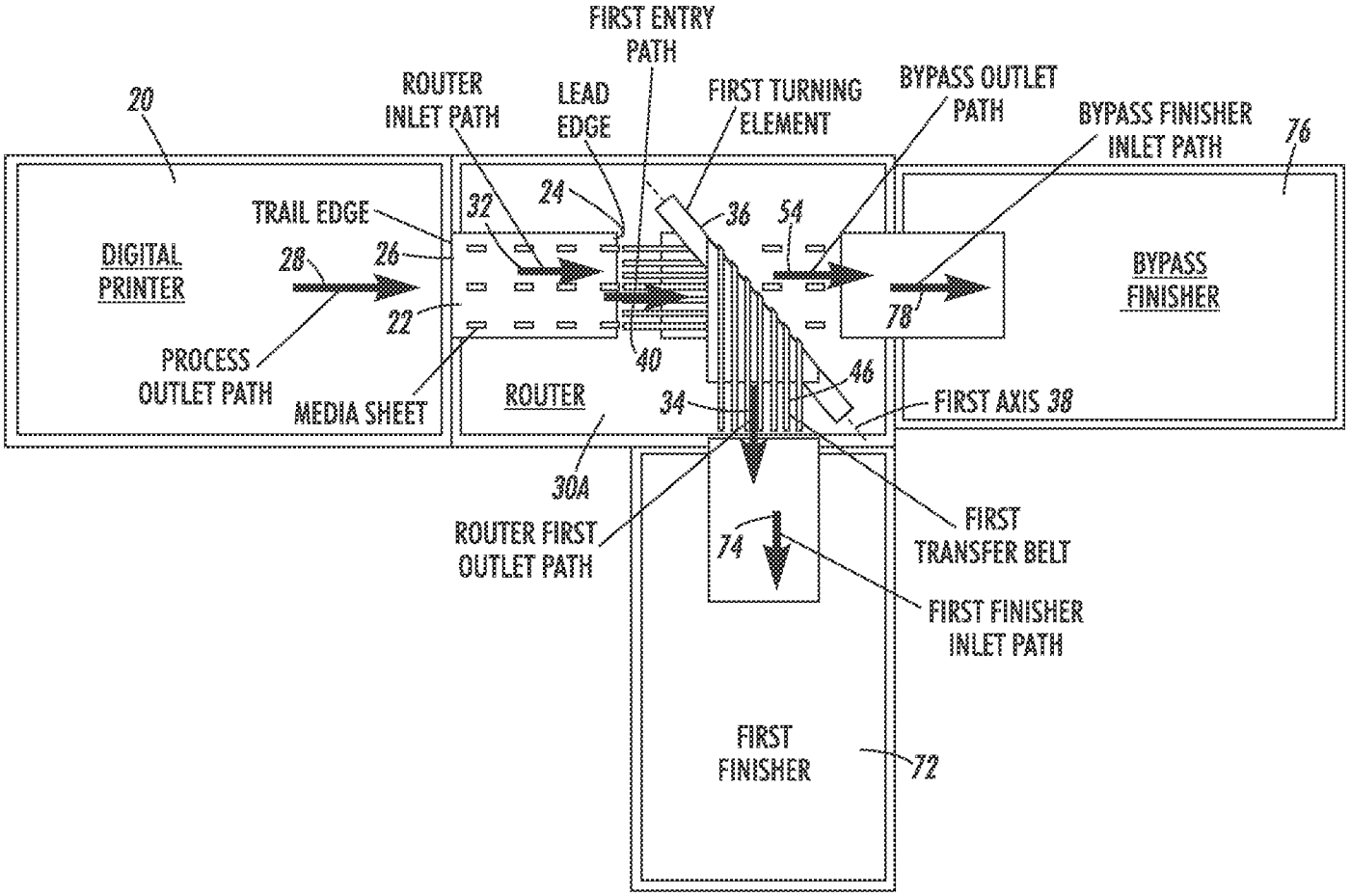
FIG. 2 is a schematic top plan view of a media sheet router constructed in accordance with the invention, and showing one turning element.

Referring to FIGS. 2-9, a media sheet router 30A, shown in FIG. 2, moves media sheets 22 from a digital printer 20 selectively to a plurality of finishers. The router 30A is used in connection with a first finisher 72 and a bypass finisher 76. A media sheet 22 has a lead edge 24 and a trail edge 26, and moves in a process direction along a process path. The router 30A comprises a router inlet path 32 for inputting the media sheet 22 into the router 30A. The router inlet path 32 is adapted for alignment with a process outlet path 28 of the printer 20. A router first outlet path 34 outputs the media sheet 22 from the router 30A to the first finisher 72. The router first outlet path 34 is disposed generally at ninety degrees to the router inlet path 32, as shown in FIG. 2. The router first outlet path 34 is adapted for alignment with a first finisher inlet path 74.

A first turning element 36 is mounted on a first axis 38 disposed generally at forty-five degrees to the router inlet path 32. The first turning element 36 has a first entry path 40 adapted for receiving the media sheet 22 from the router inlet path 32. The first turning element 36 is adapted for receiving the media sheet 22 from the first entry path 40 and directing the media sheet 22 in a helical path around the first turning element 36 and discharging the media sheet 22 to the router first outlet path 34.

In the preferred embodiment, the first turning element 36 is a first turning roller 42 mounted for rotation on the first axis 38. The first turning roller 42 has an outer surface 44 and a circumference. The first turning roller 42 is adapted for directing the media sheet 22 in a helical path around the outer surface 44 of the first turning roller 42.

Transfer belts are utilized to transfer media sheets 22 onto and off of the first turning element 36. At least one first transfer belt 46 is juxtaposed with the first turning roller outer surface 44 and extends in a helical path partway around the outer surface 44 of the first turning roller 42. The first transfer belt 46 is adapted for moving the media sheet along the first entry path 40 and holding the media sheet 22 against the first turning roller outer surface 44. The first transfer belt 46 then moves the media sheet 22 along the router first outlet path 34. One first transfer belt 46 is claimed, and seven first transfer belts 46 are shown. It is to be understood that any number of first transfer belts 46 can be utilized, within the spirit and scope of the claims.

A hold-down belt 48 can optionally be employed to aid in holding the media sheet 22 flat and in registration. The media sheet 22 LE does not change orientation during the right-angle change in direction through the router 30A. The LE entering the router along the router inlet path 32 is the same LE leaving the router along the router first outlet path 34.

Figure 3:
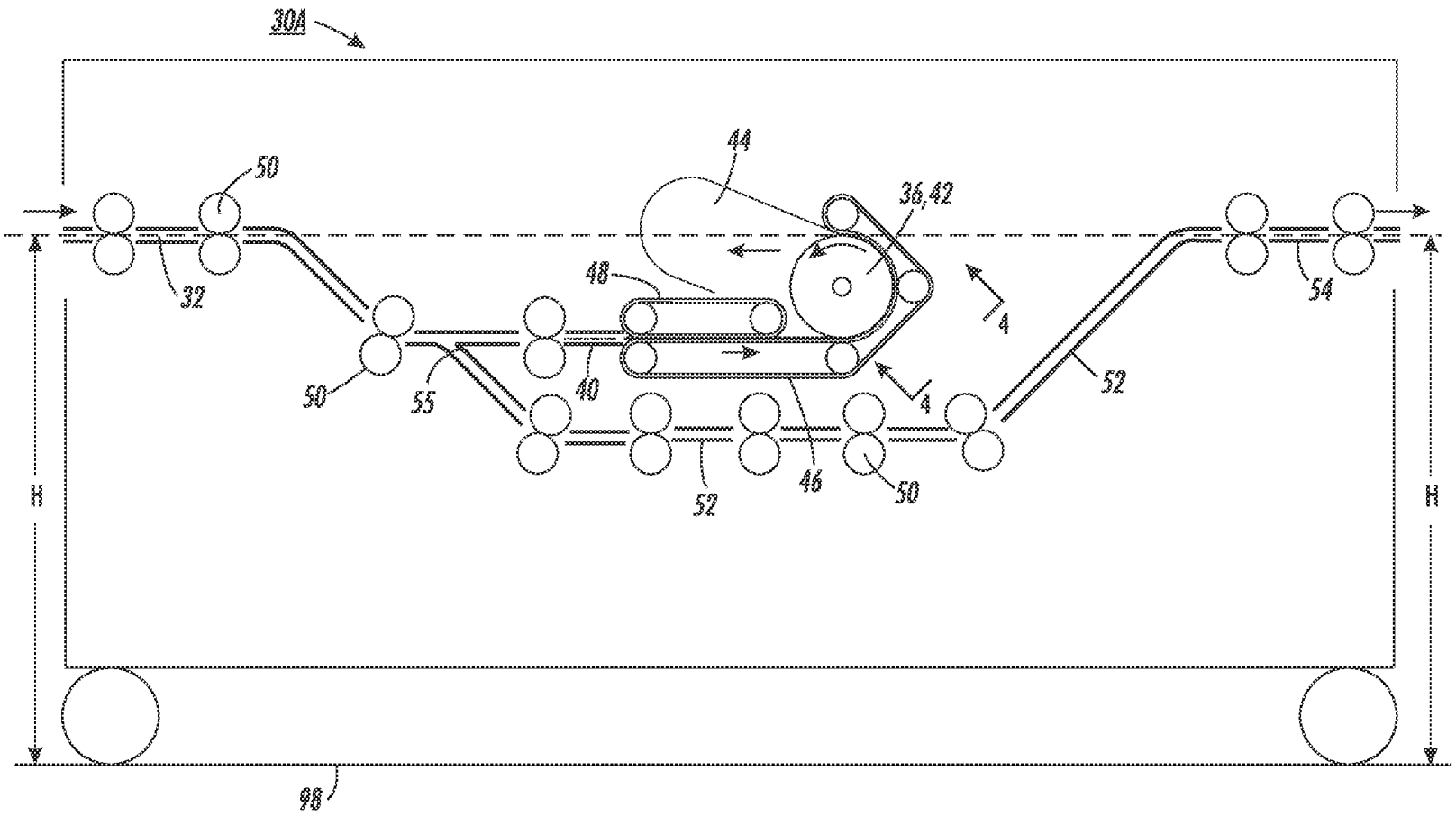
FIG. 3 is a schematic side elevational, sectional view of the media sheet router of FIG. 2.
Figure 4:
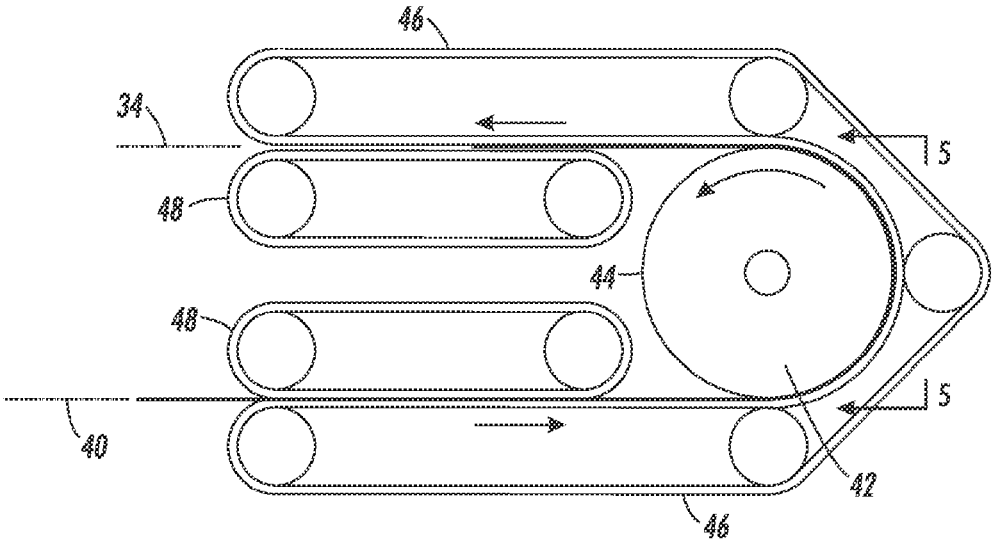
FIG. 4 is a schematic side elevational, sectional detail view the turning element and transfer belt of the media sheet router of FIG. 2, taken along lines 4-4 of FIG. 3.
Figure 5:
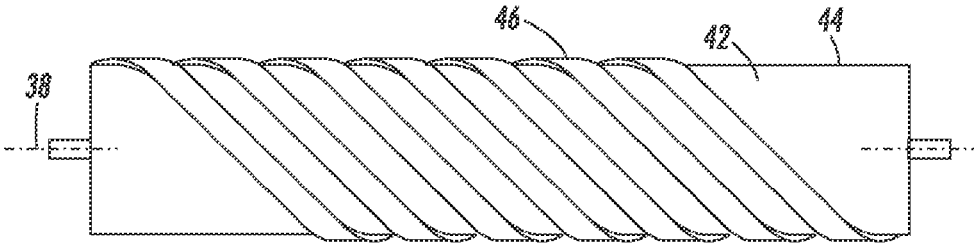
FIG. 5 is a schematic side elevational, sectional detail view of the turning element of the media sheet router of FIG. 2, taken along lines 5-5 of FIG. 4.

The first entry path 40 is on a plane below the plane of the router inlet path 32, as shown in FIG. 3. The media sheet 22 is directed from the router inlet path 32 to the first entry path 40 by means of transfer nips 50, belts, and various other means well known to those skilled in the art. In FIG. 4, the router first outlet path 34 and the first entry path 40 are not parallel, as implied by the schematic illustration. The router first outlet path 34 is generally at ninety degrees to the first entry path 40, as shown in plan view in FIG. 2.

A bypass transfer 52 moves the media sheet 22 away from the first entry path 40 and toward a bypass outlet path 54. This is to bypass the first turning element 36, or first turning roller 42. The bypass transfer 52 is shown employing nips 50, but can use belts or other transfer means. The bypass outlet path 54 is adapted for outputting the media sheet 22 from the router 30A to a bypass finisher 76. The bypass outlet path 54 is adapted for alignment with a bypass finisher inlet path 78.

A secondary diverter 55 selectively directs the media sheet 22 onto either one of the first entry path 40 or the bypass transfer 52. Hence, the router 30A is adapted for moving the media sheets 22 from the digital printer 20 through the router 30A and selectively to the plurality of finishers at full process speed. In addition, the system runs at constant velocity with no timing controls or independent motors required. Furthermore, the routing is carried out without a skipped pitch, and preferably without changing the pitch, or distance between the lead edges of adjacent media sheets. Media sheets 22 from one job can be directed to multiple finishers on the fly. This is accomplished by redirecting the sheet, not in an intermittent motion but in a continuous motion. That is, by not stopping or reversing the sheet, and by not accelerating or decelerating the media sheet at any point in the process path, or at any time. In addition, the routing is carried out by aligning the output of each apparatus with the input of the adjacent downstream apparatus. As shown in FIGS. 3, 7, 10, and 13, the distance H from the floor 98 to the inlets and outlets is uniform. Thus, the media sheets will move smoothly and rapidly from one process to the next.

Figure 6:
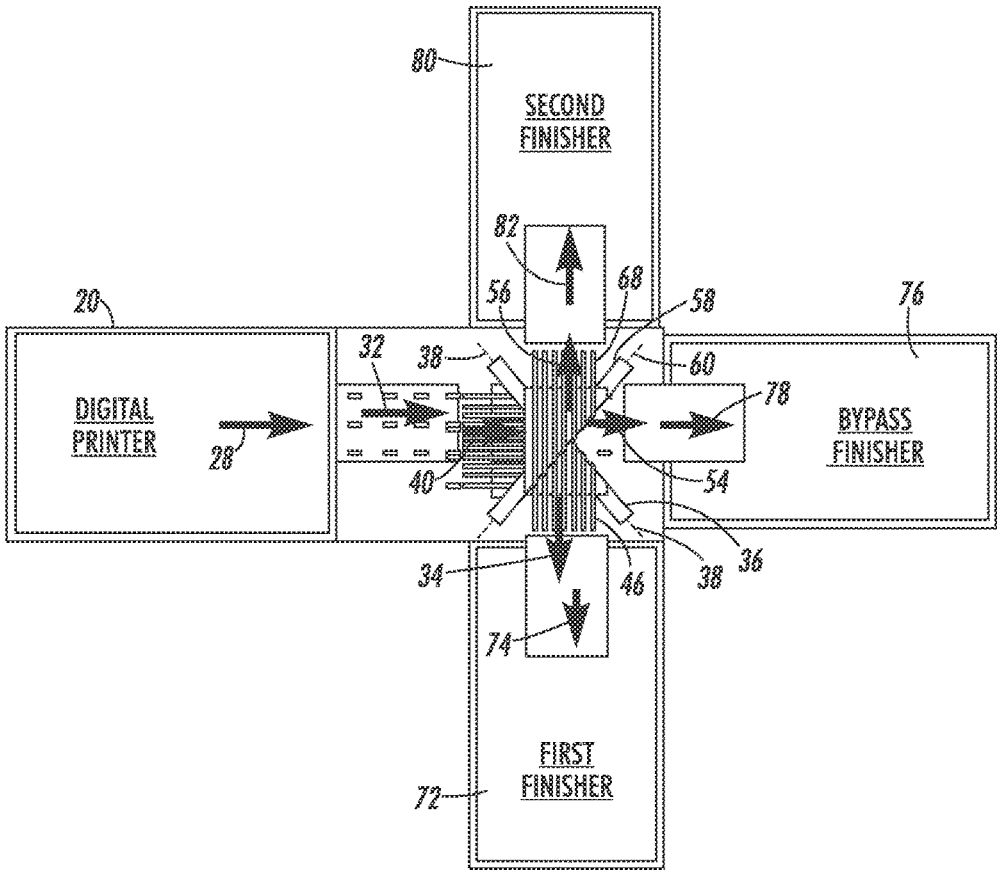
FIG. 6 is a schematic top plan view of a media sheet router constructed in accordance with the invention as in FIG. 2, and showing two turning elements.

Another media sheet router 30B, shown in FIG. 6, includes all the elements of router 30A described above. Router 30B further includes a router second outlet path 56 to output the media sheet 22 from the router 30B to a second finisher 80. The router second outlet path 56 is disposed generally at ninety degrees to the router inlet path 32. The router second outlet path 56 is generally opposed to the router first outlet path 34. The router second outlet path 56 is adapted for alignment with a second finisher inlet path 82.

A second turning element 58 is mounted on a second axis 60 disposed generally at forty-five degrees to the router inlet path 32 and generally at ninety degrees to the first axis 38. The second turning element 58 has a second entry path 62 adapted for receiving the media sheet 22 from the router inlet path 32. The second turning element 58 is adapted for receiving the media sheet 22 from the second entry path 62 and directing the media sheet 22 in a helical path around the second turning element 58 and discharging the media sheet 22 to the router second outlet path 56.

In the preferred embodiment, the second turning element 58 is a second turning roller 64 mounted for rotation on the second axis 60. The second turning roller 64 has an outer surface 66 and a circumference. The second turning roller 64 is adapted for directing the media sheet 22 in a helical path around the outer surface 66 of the second turning roller 64.

At least one second transfer belt 68 is juxtaposed with the second turning roller outer surface 66 and extends in a helical path partway around the circumference of the second turning roller 64. The second transfer belt 68 is adapted for moving the media sheet 22 along the second entry path 62 and holding the media sheet 22 against the second turning roller outer surface 66 and moving the media sheet 22 along the router second outlet path 56. One second transfer belt 68 is claimed, and seven second transfer belts 68 are shown. It is to be understood for all embodiments, that any number of second transfer belts 68 can be utilized, within the spirit and scope of the claims.

As described above, a hold-down belt 48 can optionally be employed to aid in holding the media sheet 22 flat and in registration. The media sheet 22 LE does not change orientation during the right-angle change in direction through the routers 30A or 30B. The LE entering the router along the router inlet path 32 is the same LE leaving the router along the router second outlet path 56.

Figure 7:
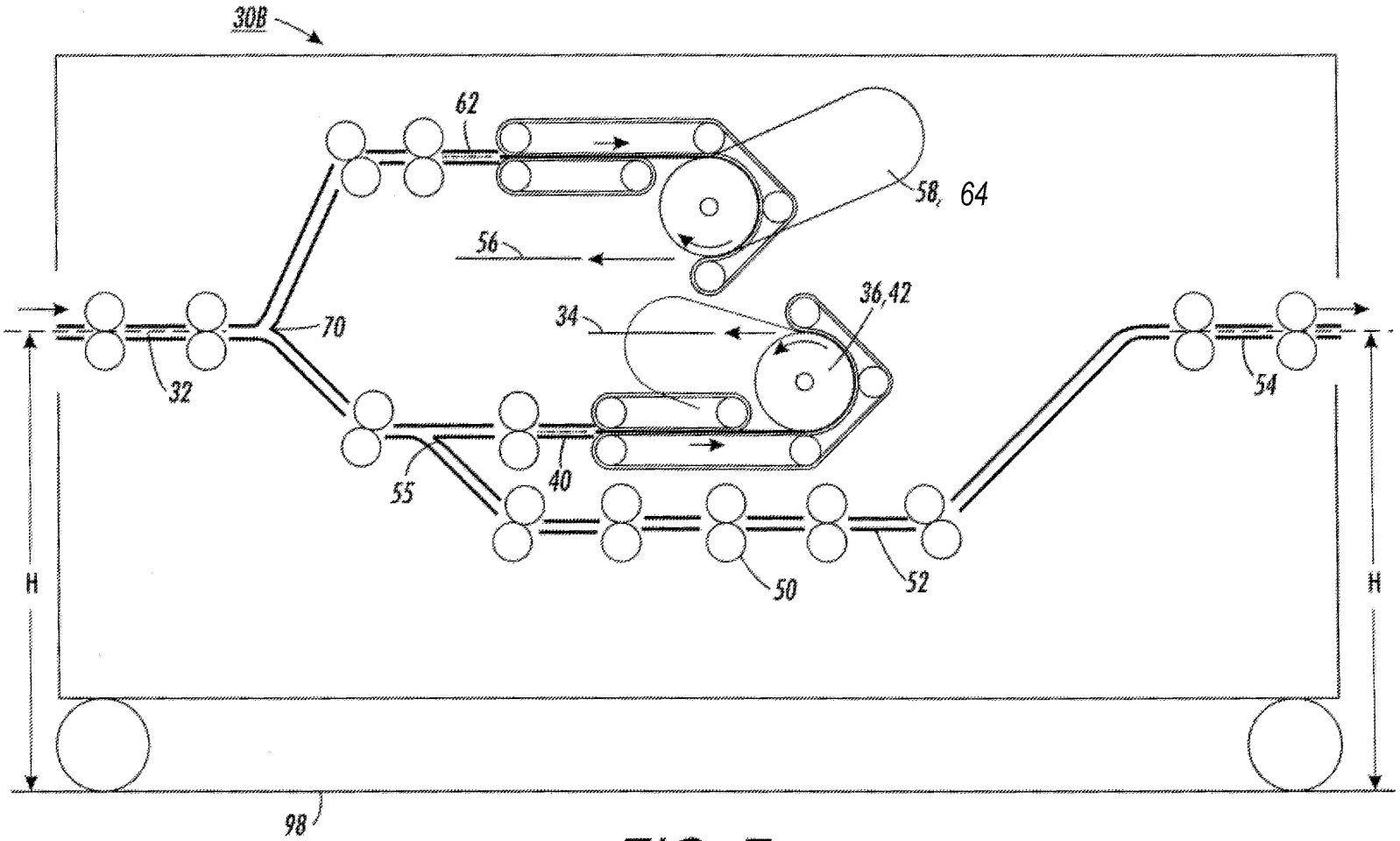
FIG. 7 is a schematic side elevational, sectional view of the media sheet router of FIG. 6.

The second entry path 62 is on a plane above the plane of the router inlet path 32, as shown in FIG. 7. The media sheet 22 is directed from the router inlet path 32 to the second entry path 62 by means of transfer nips 50, belts, and various other means well known to those skilled in the art. The router second outlet path 56 and the second entry path 62 are not parallel. The router second outlet path 56 is generally at ninety degrees to the second entry path 62.

As shown in FIGS. 6-9, the first turning element 36 discharges the media sheet 22 to the right of the router inlet path 32, facing downstream. It is to be understood that the first turning element 36 can discharge the media sheet 22 to the right or to the left of the router inlet path 32. Similarly, the second turning element 58 discharges the media sheet 22 to the left of the router inlet path 32, facing downstream. It is to be understood that the second turning element 58 can discharge the media sheet 22 to the right or to the left of the router inlet path 32. The right and left discharge directions with respect to the first 36 and second 58 turning elements are equivalent within the spirit and scope of the claims.

A primary diverter 70 selectively directs the media sheet 22 onto either one of the first entry path 40 or the second entry path 62. The primary diverter 70 and secondary diverter 55 are well known to those skilled in the art.

Figure 8:
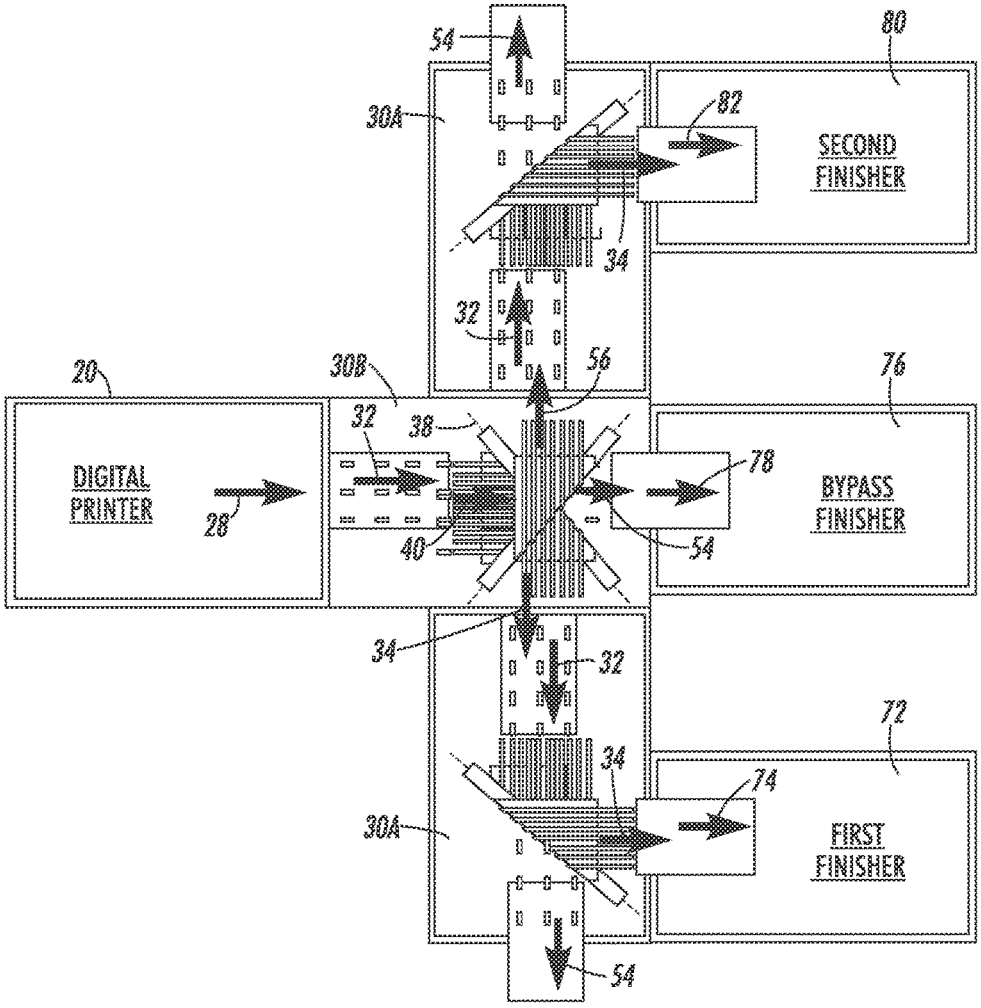
FIG. 8 is a schematic top plan view of the media sheet routers of FIGS. 2 and 6, showing an application assembly.

FIG. 8 depicts an arrangement of three routers and three finishers. Media sheets 22 are discharged from printer 20 along process outlet path 28 into the router inlet path 32 of router 30B. Media sheets 22 selectively follow any of three routes. Firstly, router first outlet path 34 to a first router 30A to the first finisher 72. Secondly, router second outlet path 56 to a second router 30A turning in the opposite direction to that of first router 30A, to the second finisher 80. Thirdly, bypass outlet path 54 to the bypass finisher 76. The bypass outlet paths 54 of the first and second routers 30A could be directed to additional routers and finishers (not shown) adjacent to those shown. This indicates the versatility of the modular routers.

Figure 9:
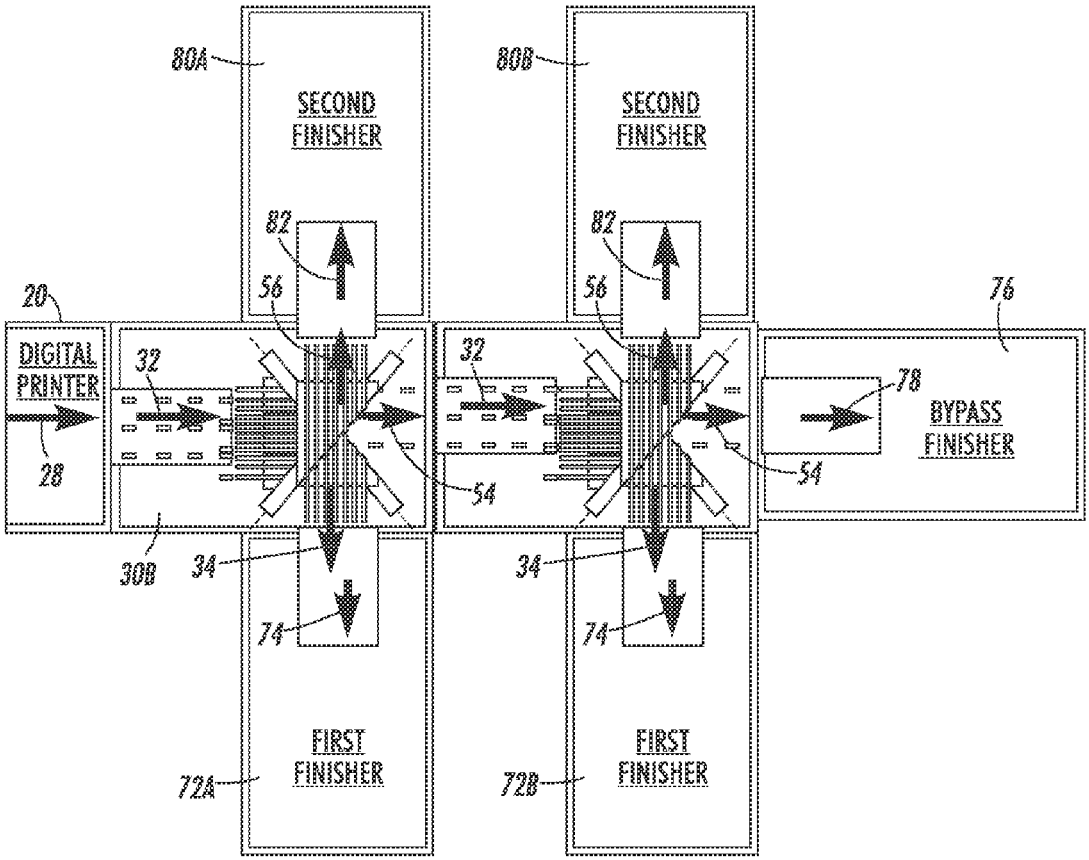
FIG. 9 is a schematic top plan view of the media sheet routers of FIGS. 2 and 6, showing another application assembly.

FIG. 9 depicts another arrangement of two routers and five finishers. Media sheets 22 are discharged from printer 20 along process outlet path 28 into the router inlet path 32 of first router 30B. Media sheets 22 selectively follow any of three routes. Firstly, router first outlet path 34 to a first finisher 72A. Secondly, router second outlet path 56 to a second finisher 80A. Thirdly, bypass outlet path 54 to second router 30B. Three new routes can be selected. Fourthly, router first outlet path 34 to a first finisher 72B. Fifthly, router second outlet path 56 to a second finisher 80B. Sixthly, bypass outlet path 54 to the bypass finisher 76. Additional routers and finishers (not shown) can be added. This example further indicates the versatility of the modular routers. Any combination of routers and finishers can be assembled to accommodate the printing requirements and floor plan. All of them operate at full process speed.

Figure 10:
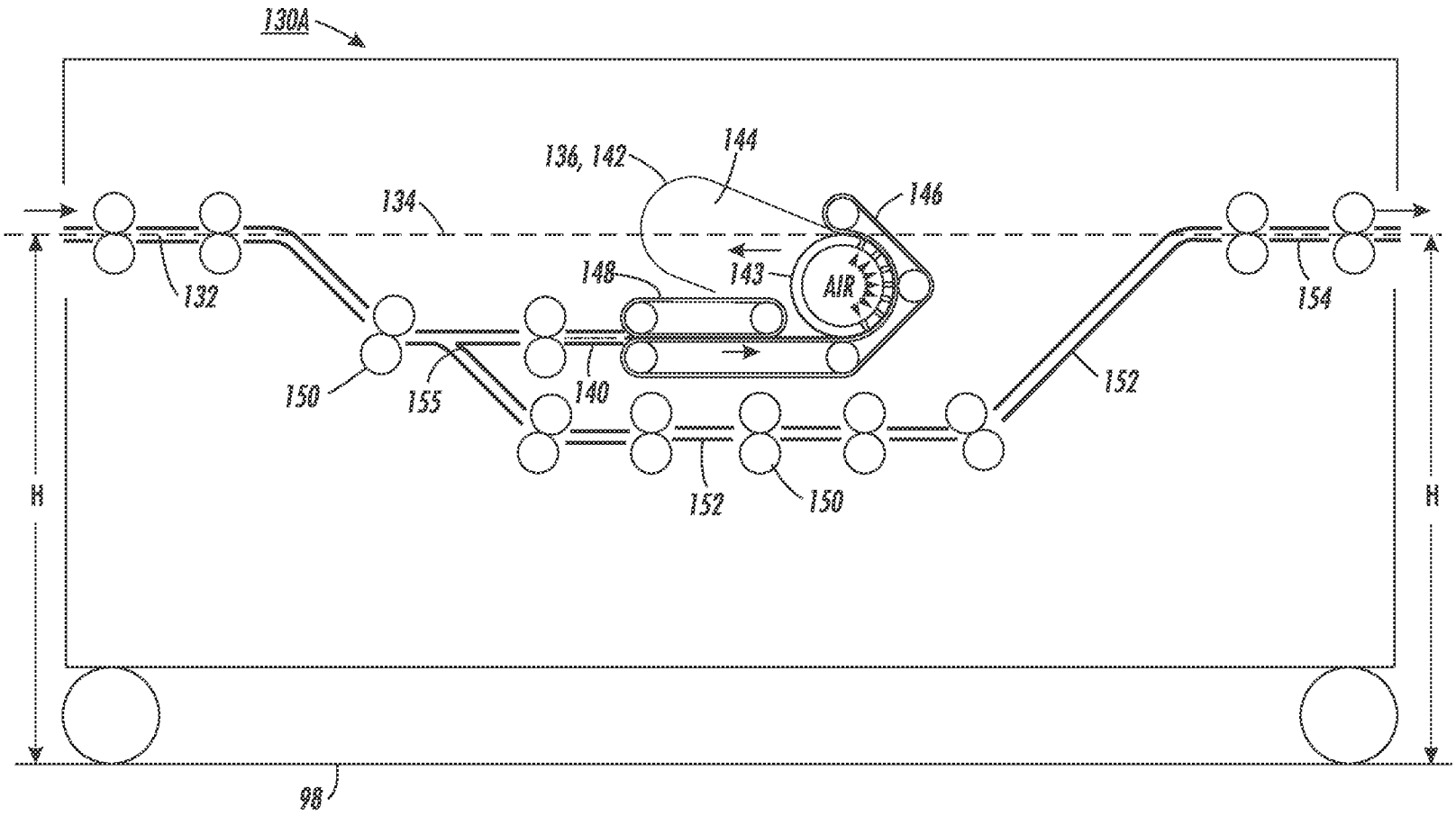
FIG. 10 is a schematic top plan view of another media sheet router constructed in accordance with the invention, and showing one turning element.

Turning now to FIGS. 10-13, another media sheet router 130A, shown in FIG. 10, moves media sheets 22 from a digital printer 20 selectively to a plurality of finishers. The router 130A is similar to router 30A described above, in that router 130A is used in connection with a first finisher 72 and a bypass finisher 76. The router 130A comprises a router inlet path 132 for inputting the media sheet 22 into the router 130A. The router inlet path 132 is adapted for alignment with the process outlet path 28 of the printer 20. A router first outlet path 134 outputs the media sheet 22 from the router 130A to the first finisher 72. The router first outlet path 134 is disposed generally at ninety degrees to the router inlet path 132, similar to that shown in FIG. 2 above. The router first outlet path 134 is adapted for alignment with a first finisher inlet path 74.

A first turning element 136 is mounted on a first axis 138 disposed generally at forty-five degrees to the router inlet path 132. The first turning element 136 has a first entry path 140 adapted for receiving the media sheet 22 from the router inlet path 132. The first turning element 136 is adapted for receiving the media sheet 22 from the first entry path 140 and directing the media sheet 22 in a helical path around the first turning element 136 and discharging the media sheet 22 to the router first outlet path 134.

The router 130A differs from router 30A described above, in that the first turning element 136 includes a first turning cylinder 142 mounted fixedly on the first axis 138. The first turning cylinder 142 is hollow, and has a wall 143, an outer surface 144, and a circumference. An array of holes 145 extends through the wall 143. The array of holes 145 is shown as helical, but can be any pattern. The first turning cylinder 142 is adapted for directing the media sheet 22 in a helical path around the outer surface 144 of the first turning cylinder 142.

At least one first transfer belt 146 is juxtaposed with the first turning cylinder outer surface 144 and extends in a helical path partway around the outer surface 144 of the first turning cylinder 142. The first transfer belt 146 is shown as being aligned with the array of holes 145, but need not be aligned. The first transfer belt 146 is adapted for moving the media sheet 22 along the first entry path 140 and holding the media sheet 22 against the first turning cylinder outer surface 144 and moving the media sheet along the router first outlet path 134. A hold-down belt 148 can optionally be employed to aid in holding the media sheet 22 flat and in registration.

An antifriction coating 185 includes a layer of air between the first turning cylinder outer surface 144 and the first transfer belt 146. A blower 195 communicates with the first turning cylinder and with the holes, for supplying air to the antifriction coating.

Figure 11:
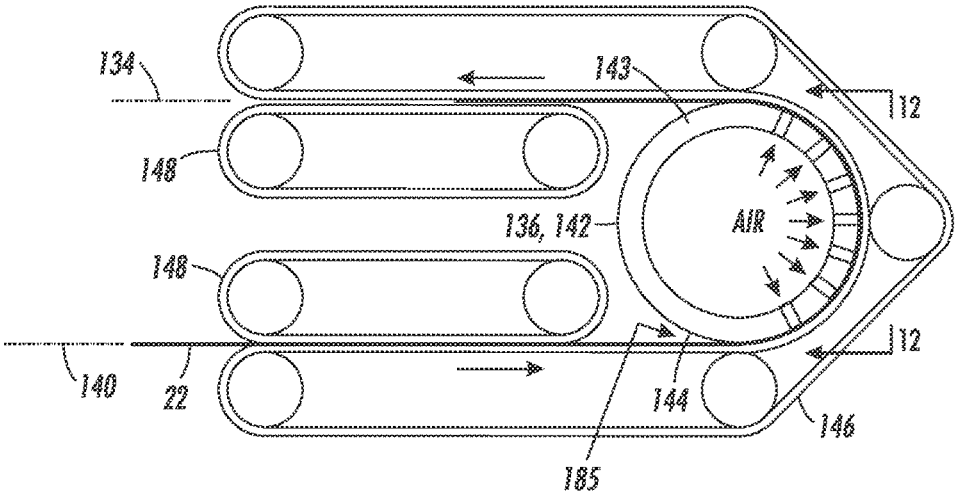
FIG. 11 is a schematic side elevational, sectional detail view the turning element and transfer belt of the media sheet router of FIG. 10, taken along lines 11-11 of FIG. 10.
Figure 12:
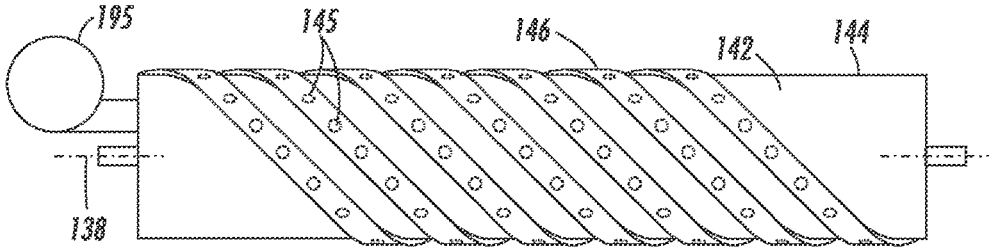
FIG. 12 is a schematic side elevational, sectional detail view of the turning element of the media sheet router of FIG. 10, taken along lines 12-12 of FIG. 11.

The first entry path 140 is on a plane below the plane of the router inlet path 32, as shown in FIG. 10. The media sheet 22 is directed from the router inlet path 132 to the first entry path 140 by means of transfer nips 150, belts, and various other means well known to those skilled in the art. In FIG. 11, the router first outlet path 34 and the first entry path 40 are not parallel, as implied by the schematic illustration. The router first outlet path 134 is generally at ninety degrees to the first entry path 140.

A bypass transfer 152 moves the media sheet 22 away from the first entry path 140 and toward a bypass outlet path 154. This is to bypass the first turning element 136, or first turning cylinder 142. The bypass transfer 152 is shown employing nips 150, but can use belts or other transfer means. The bypass outlet path 154 is adapted for outputting the media sheet 22 from the router 130A to a bypass finisher 76. The bypass outlet path 154 is adapted for alignment with a bypass finisher inlet path 78.

A secondary diverter 155 selectively directs the media sheet 22 onto either one of the first entry path 140 or the bypass transfer 152. Hence, the router 130A is adapted for moving the media sheets 22 from the digital printer 20 through the router 130A and selectively to the plurality of finishers at full process speed.

Figure 13:
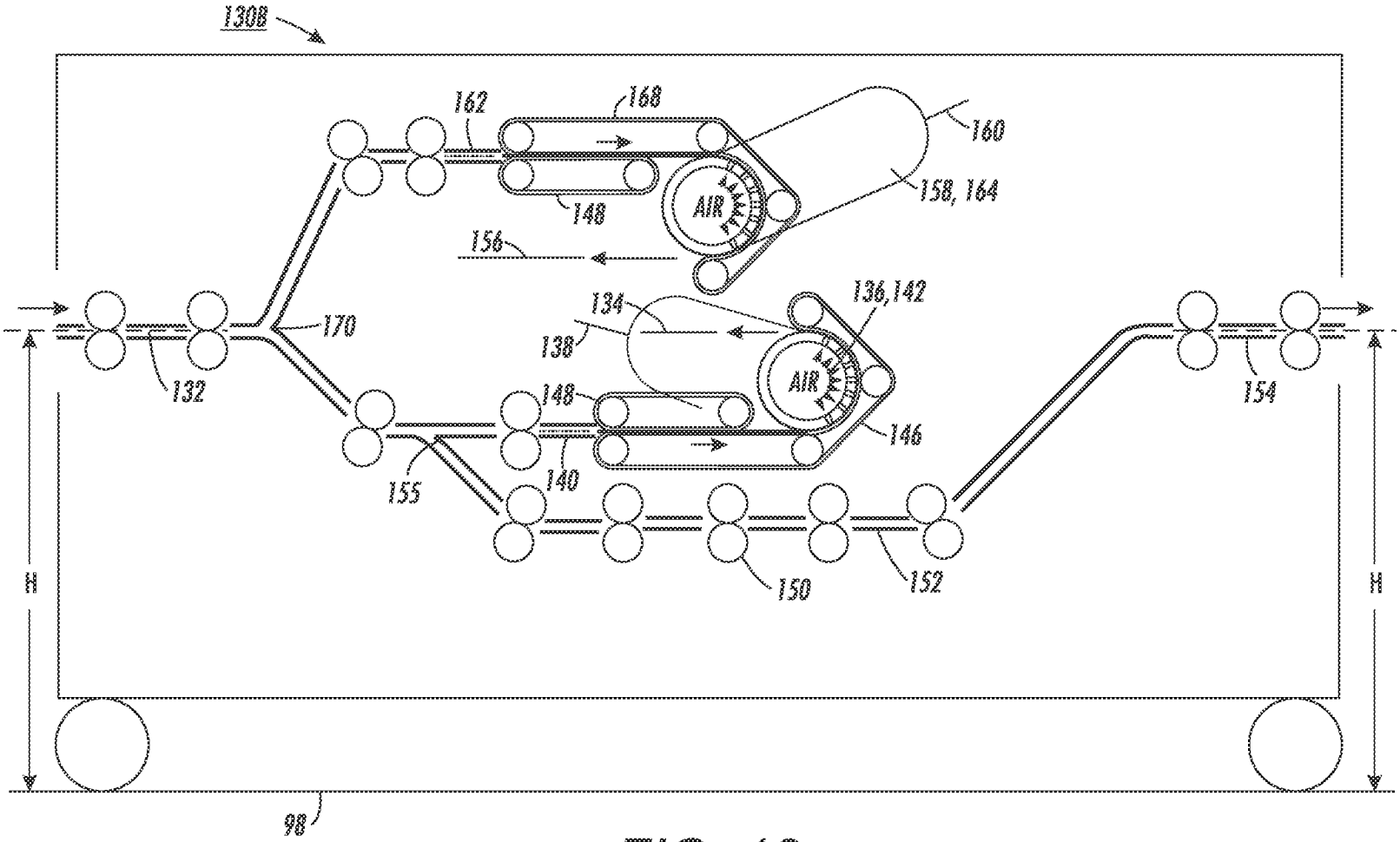
FIG. 13 is a schematic side elevational, sectional view of the media sheet router of FIG. 10, and showing two turning elements.

Another media sheet router 130B, shown in FIG. 13, includes all the elements of router 130A described above. Router 130B further includes a router second outlet path 156 to output the media sheet 22 from the router 130B to a second finisher 80. The router second outlet path 156 is disposed generally at ninety degrees to the router inlet path 132. The router second outlet path 156 is generally opposed to the router first outlet path 134. The router second outlet path 156 is adapted for alignment with a second finisher inlet path 82.

A second turning element 158 is mounted on a second axis 160 disposed generally at forty-five degrees to the router inlet path 132 and generally at ninety degrees to the first axis 138. The second turning element 158 has a second entry path 162 adapted for receiving the media sheet 22 from the router inlet path 132. The second turning element 158 is adapted for receiving the media sheet 22 from the second entry path 162 and directing the media sheet 22 in a helical path around the second turning element 158 and discharging the media sheet 22 to the router second outlet path 156.

In this embodiment, the second turning element 158 includes a second turning cylinder 164 mounted fixedly on the second axis 160. The second turning cylinder 164 is hollow, and has a wall 165, an outer surface 166, and a circumference. An array of holes 167 extends through the wall 165. The second turning cylinder 164 is adapted for directing the media sheet 22 in a helical path around the outer surface 166 of the second turning cylinder 164.

At least one second transfer belt 168 is juxtaposed with the second turning cylinder outer surface 166 and extends in a helical path partway around the outer surface 166 of the second turning cylinder 164. The second transfer belt 168 is adapted for moving the media sheet 22 along the second entry path 162 and holding the media sheet 22 against the second turning cylinder outer surface 166 and moving the media sheet along the router second outlet path 156.

A primary diverter 170 selectively directs the media sheet 22 onto either one of the first entry path 140 or the second entry path 162. The primary diverter 170 and secondary diverter 155 are well known to those skilled in the art.

The antifriction coating 185 is also included between the second turning cylinder outer surface 166 and the second transfer belt 168. The blower 195 communicates with the second turning cylinder 164 and with the holes 167, for supplying air to the antifriction coating 185.

Figure 14:
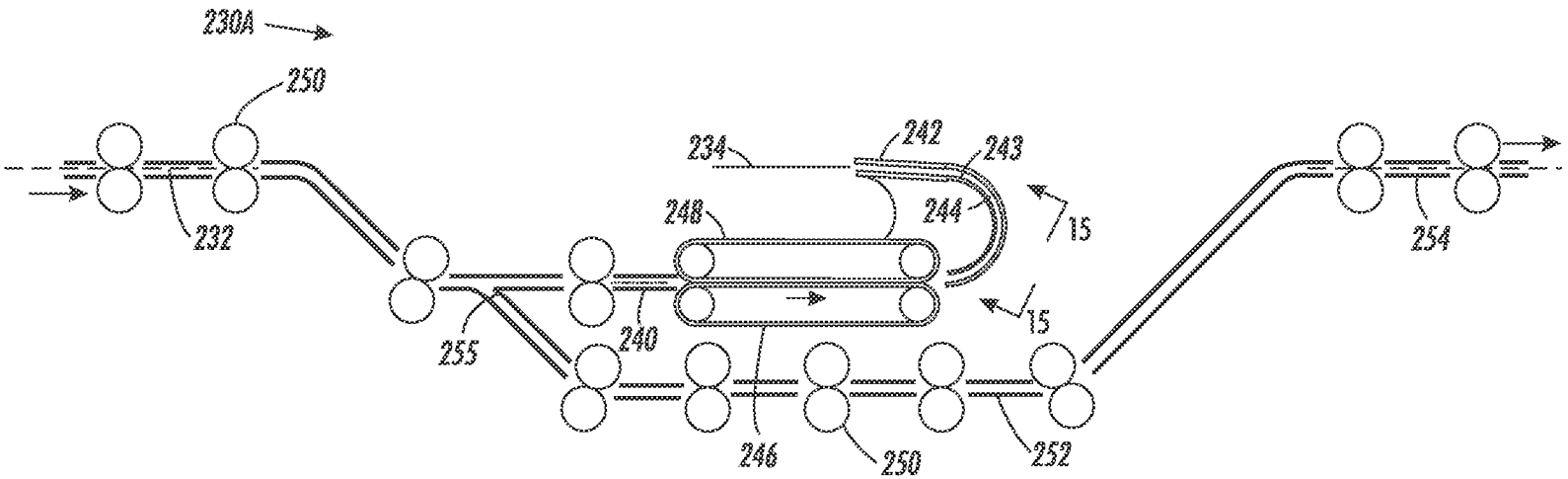
FIG. 14 is a schematic top plan view of yet another media sheet router constructed in accordance with the invention, and showing one turning element.

Referring now to FIGS. 14-17, yet another media sheet router 230A, shown in FIG. 14, moves media sheets 22 from a digital printer 20 selectively to a plurality of finishers. The router 230A is similar to router 30A described above, in that router 230A is used in connection with a first finisher 72 and a bypass finisher 76. The router 230A comprises a router inlet path 232 for inputting the media sheet 22 into the router 230A. The router inlet path 232 is adapted for alignment with the process outlet path 28 of the printer 20. A router first outlet path 234 outputs the media sheet 22 from the router 230A to the first finisher 72. The router first outlet path 234 is disposed generally at ninety degrees to the router inlet path 232, similar to that shown in FIG. 2 above. The router first outlet path 234 is adapted for alignment with a first finisher inlet path 74.

A first turning element 236 is mounted on a first axis 238 disposed generally at forty-five degrees to the router inlet path 232. The first turning element 236 has a first entry path 240 adapted for receiving the media sheet 22 from the router inlet path 232. The first turning element 236 is adapted for receiving the media sheet 22 from the first entry path 240 and directing the media sheet 22 in a helical path around the first turning element 236 and discharging the media sheet 22 to the router first outlet path 234.

The router 230A differs from router 30A described above, in that the first turning element 236 includes an arcuate first outer turning element 242 concentrically surrounding an arcuate first inner turning element 243. The first inner 243 and first outer 242 elements extend in a semicircle about the first axis 238. The first inner 243 and first outer 242 elements extend between opposite ends and are spaced apart to define an arcuate first slot 244 therebetween. The first slot 244 is adapted for receiving the media sheet 22 from the first entry path 240 and directing the media sheet 22 in a helical path through the first slot 244 to the router first outlet path 234.

A polymeric antifriction coating 285 is applied inside the first slot 244 on the first inner 243 and first outer 242 elements. The antifriction coating 285 can comprise any material having a low coefficient of friction. Typical examples include polyethylene, polytetrafluoroethylene, Delrin®, and nylon.

At least one first transfer 246 is juxtaposed with the first slot 244. The first transfer 246 is adapted for moving the media sheet along the first entry path 240. The first transfer 246 is shown as a belt, but can be nip rollers, or other means well known to those skilled in the art.

Figure 15:
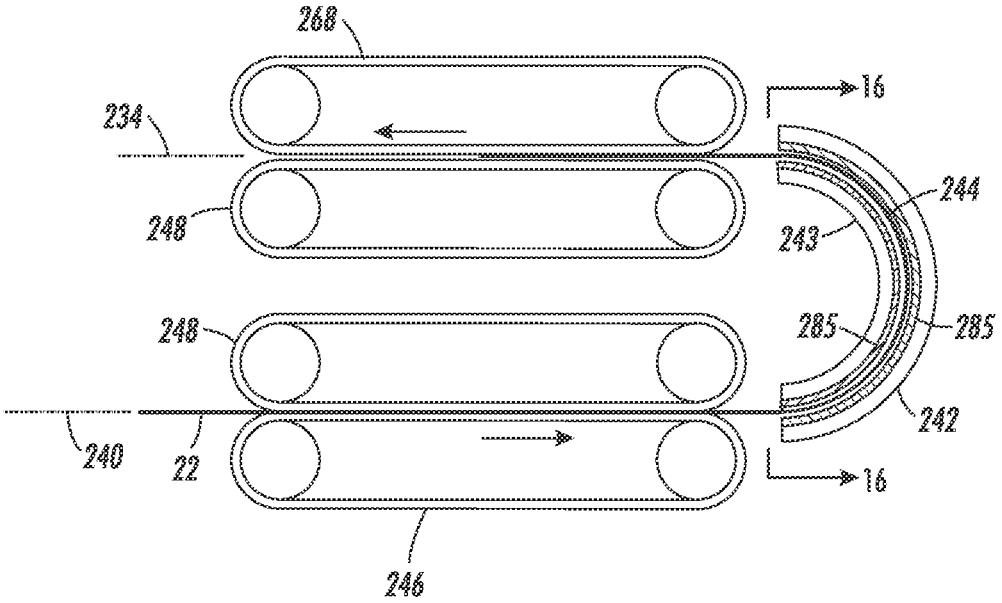
FIG. 15 is a schematic side elevational, sectional detail view the turning element and transfer belt of the media sheet router of FIG. 14, taken along lines 15-15 of FIG. 14.
Figure 16:
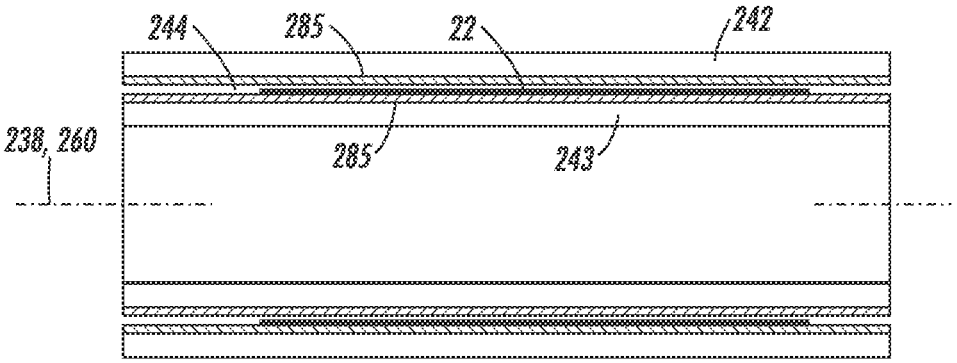
FIG. 16 is a schematic side elevational, sectional detail view of the turning element of the media sheet router of FIG. 14, taken along lines 16-16 of FIG. 15.

The first entry path 240 is on a plane below the plane of the router inlet path 232, as shown in FIG. 14. The media sheet 22 is directed from the router inlet path 232 to the first entry path 240 by means of transfer nips 250, belts, and various other means well known to those skilled in the art. In FIG. 15, the router first outlet path 234 and the first entry path 240 are not parallel, as implied by the schematic illustration. The router first outlet path 234 is generally at ninety degrees to the first entry path 240.

A bypass transfer 252 moves the media sheet 22 away from the first entry path 240 and toward a bypass outlet path 254. This is to bypass the first turning element 236, which includes the first inner 243 and first outer 242 elements and the first slot 244. The bypass transfer 252 is shown employing nips 250, but can use belts or other transfer means. The bypass outlet path 254 is adapted for outputting the media sheet 22 from the router 230A to a bypass finisher 76. The bypass outlet path 254 is adapted for alignment with a bypass finisher inlet path 78.

A secondary diverter 255 selectively directs the media sheet 22 onto either one of the first entry path 240 or the bypass transfer 252. Hence, the router 230A is adapted for moving the media sheets 22 from the digital printer 20 through the router 230A and selectively to the plurality of finishers at full process speed.

Figure 17:
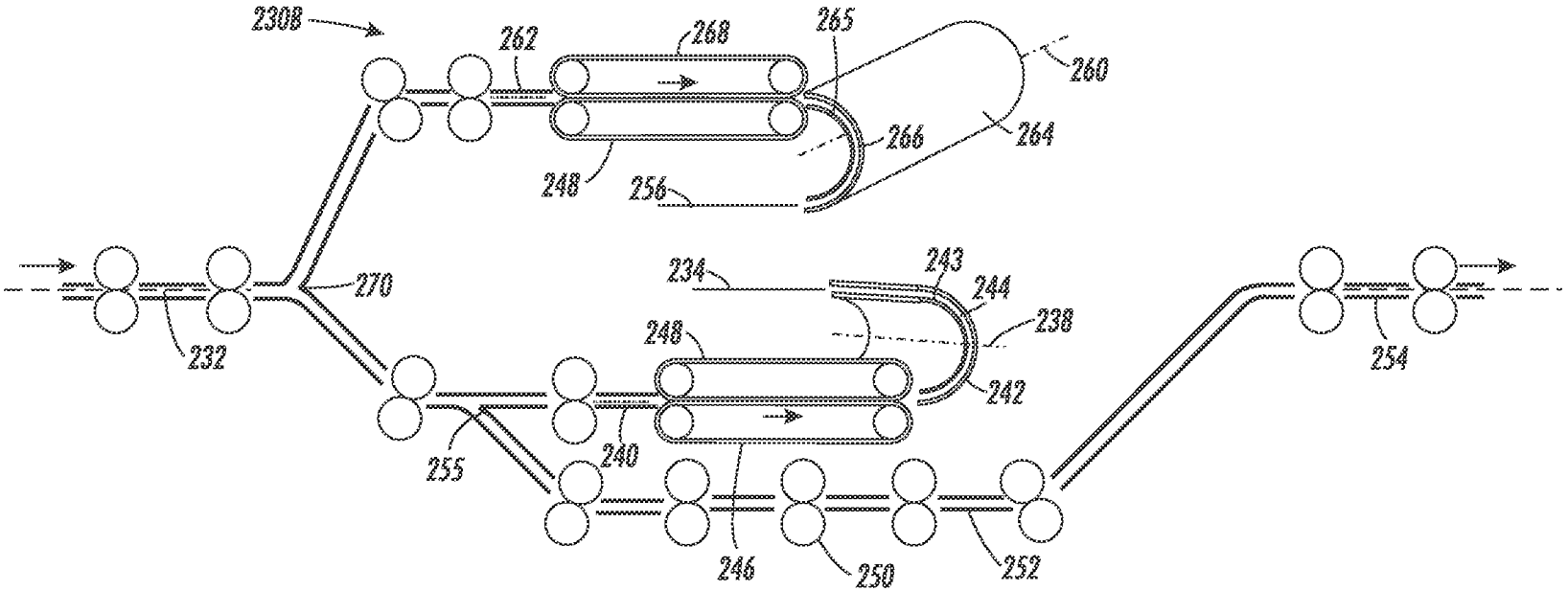
FIG. 17 is a schematic side elevational, sectional view of the media sheet router of FIG. 14, and showing two turning elements.

Another media sheet router 230B, shown in FIG. 17, includes all the elements of router 230A described above. Router 230B further includes a router second outlet path 256 to output the media sheet 22 from the router 230B to a second finisher 80. The router second outlet path 256 is disposed generally at ninety degrees to the router inlet path 232. The router second outlet path 256 is generally opposed to the router first outlet path 234. The router second outlet path 256 is adapted for alignment with a second finisher inlet path 82.

A second turning element 258 is mounted on a second axis 260 disposed generally at forty-five degrees to the router inlet path 232 and generally at ninety degrees to the first axis 238. The second turning element 258 has a second entry path 262 adapted for receiving the media sheet 22 from the router inlet path 232. The second turning element 258 is adapted for receiving the media sheet 22 from the second entry path 262 and directing the media sheet 22 in a helical path around the second turning element 258 and discharging the media sheet 22 to the router second outlet path 256.

In this embodiment, the second turning element 258 includes an arcuate second outer turning element 264 concentrically surrounding an arcuate second inner turning element 265. The second inner 265 and second outer 264 elements extend in a semicircle about the second axis 260. The second inner 265 and second outer 264 elements extend between opposite ends and are spaced apart to define an arcuate second slot 266 therebetween. The second slot 266 is adapted for receiving the media sheet 22 from the second entry path 262 and directing the media sheet 22 in a helical path through the second slot 266 to the router second outlet path 256.

A polymeric antifriction coating 285 is applied inside the second slot 266 on the second inner 265 and second outer 264 elements.

A primary diverter 270 selectively directs the media sheet 22 onto either one of the first entry path 240 or the second entry path 262. The primary diverter 270 and secondary diverter 255 are well known to those skilled in the art.

A method is disclosed for routing media sheets from a digital printer to a plurality of finishers. The method is used in connection with a first finisher 72 and a bypass finisher 76. The method comprises providing a router 30A for routing the media sheets 22 and aligning a process outlet path 28 of the printer with a router inlet path 32. The media sheet 22 is moved from the process outlet path 28 of the printer into the router inlet path 32. A router first outlet path 34 is disposed generally at ninety degrees to the router inlet path 32. The router first outlet path 34 is aligned with a first finisher inlet path 74.

A first turning element 36 is disposed on a first axis 38 generally at forty-five degrees to the router inlet path 32. The media sheet 22 is received from the router inlet path 32. The media sheet 22 is directed in a helical path around the first turning element 36 and to the router first outlet path 34 when the first finisher 72 is selected. The media sheet 22 is discharged from the router 30A along the router first outlet path 34. The media sheet 22 is moved into the first finisher inlet path 74.

A bypass transfer 52 is provided around the first turning element 36 to a router bypass outlet path 54. The router bypass outlet path 54 is aligned with a bypass finisher inlet path 78. The media sheet 22 is received from the router inlet path 32 and directed to the router bypass outlet path 54 when the bypass transfer is selected. The media sheet 22 is moved from the router bypass outlet path 54 into the bypass finisher inlet path 78. Thus, the media sheet 22 is moved from the digital printer 20 through the router 30A and selectively to the plurality of finishers at full process speed.

A secondary diverter 55 is provided between the first turning element 36 and the bypass transfer 52. The media sheet is selectively directed onto a one of the first turning element and the bypass transfer with the secondary diverter.

A first turning roller 42 is mounted for rotation on the first axis 38 as the first turning element. At least one first transfer belt 46 is juxtaposed with an outer surface 44 of the first turning roller 42. The first transfer belt 46 is extended in a helical path partway around the outer surface 44 of the first turning roller 42. The media sheet 22 is held against the first turning roller outer surface 44 with the first transfer belt 46 and directed in a helical path around the first turning roller outer surface 44 when the first finisher 72 is selected.

In connection with a second finisher 80, the method further comprises disposing a router second outlet path 56 generally at ninety degrees to the router inlet path 32 and opposed to the router first outlet path 34. The router second outlet path 56 is aligned with a second finisher inlet path 82. A second turning element 58 is disposed on a second axis 60 generally at forty-five degrees to the router inlet path 32. The second turning element 58 is disposed generally at ninety degrees to the first turning element 36.

The media sheet 22 is received from the router inlet path 32 and directed in a helical path around the second turning element 58. The media sheet 22 is directed to the router second outlet path 56 when the second finisher 80 is selected. The media sheet 22 is then discharged from the router 30B along the router second outlet path 56 and moved into the second finisher inlet path 82.

A primary diverter 70 is provided between the first turning element 36 and the second turning element 58. The media sheet 22 is selectively directed onto either one of the first turning element 36 or the second turning element 58 with the primary diverter 70.

In addition to the first turning roller 42, a second turning roller 64 is mounted for rotation on the second axis 60 as the second turning element 58. At least one second transfer belt 68 is juxtaposed with an outer surface 66 of the second turning roller 64. The second transfer belt 68 is extended in a helical path partway around the outer surface 66 of the second turning roller 64. The media sheet 22 is held against the second turning roller outer surface 66 with the second transfer belt 68. The media sheet 22 is directed in a helical path around the second turning roller outer surface 66 with the second transfer belt 68 when the second finisher 80 is selected.

In another embodiment, the method further comprises mounting a first turning cylinder 142 fixedly on the first axis 138 as the first turning element 136. An array of holes 145 is formed through a wall 143 of the first turning cylinder 142. At least one first transfer belt 146 is juxtaposed with an outer surface 144 of the first turning cylinder 142. The first transfer belt 146 is extended in a helical path partway around the outer surface 144 of the first turning cylinder 142. The media sheet 22 is held against the first turning cylinder outer surface 144 with the first transfer belt 146. The media sheet 22 is directed in a helical path around the first turning cylinder outer surface 144 with the first transfer belt 146 when the first finisher 72 is selected. An antifriction coating 185 is formed by blowing a layer of air between the first turning cylinder outer surface 144 and the first transfer belt 146 through the array of holes 145.

A second turning cylinder 164 is mounted fixedly on the second axis 160 as the second turning element 158. An array of holes 167 is formed through a wall 165 of the second turning cylinder 164. At least one second transfer belt 168 is juxtaposed with an outer surface 166 of the second turning cylinder 164. The second transfer belt 168 is extended in a helical path partway around the outer surface 166 of the second turning cylinder 164. The media sheet 22 is held against the second turning cylinder outer surface 166 with the second transfer belt 168. The media sheet 22 is directed in a helical path around the second turning cylinder outer surface 166 with the second transfer belt 168 when the second finisher 80 is selected. An antifriction coating 185 is formed by blowing a layer of air between the second turning cylinder outer surface 166 and the second transfer belt 168 through the array of holes 167.

In yet another embodiment, the method further comprises mounting an arcuate first outer turning element 242 concentrically surrounding an arcuate first inner turning element 243 on the first axis 238 as the first turning element 236. The first inner 243 and first outer 242 elements are spaced apart to define an arcuate first slot 244 therebetween. A polymeric antifriction coating 285 is formed inside the first slot 244 on the first inner 243 and first outer 242 elements. The media sheet 22 is received in the first slot 244. The media sheet 22 is directed in a helical path through the first slot 244 to the router first outlet path 234 when the first finisher 72 is selected.

An arcuate second outer turning element 264 is mounted concentrically surrounding an arcuate second inner turning element 265 on the second axis 260 as the second turning element 258. The second inner 265 and second outer 264 elements are spaced apart to define an arcuate second slot 266 therebetween. A polymeric antifriction coating 285 is formed inside the second slot 266 on the second inner 265 and second outer 264 elements. The media sheet 22 is received in the second slot 266. The media sheet 22 is directed in a helical path through the second slot 266 to the router second outlet path 256 when the second finisher 80 is selected.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A media sheet router for routing media sheets from a digital printer selectively to a plurality of finishers, for use in connection with a first finisher and a bypass finisher, and a media sheet having a lead edge and a trail edge, the media sheet moving in a process direction along a process path, the router comprising:

a router inlet path for inputting the media sheet into the router, the router inlet path being adapted for alignment with a process outlet path of the printer;

a router first outlet path for outputting the media sheet from the router, the router first outlet path being disposed at ninety degrees to the router inlet path, the router first outlet path being adapted for alignment with a first finisher inlet path;

a first turning element mounted on a first axis disposed at forty-five degrees to the router inlet path, the first turning element having a first entry path adapted for receiving the media sheet from the router inlet path, the first turning element being adapted for receiving the media sheet from the first entry path and directing the media sheet in a helical path around the first turning element and discharging the media sheet to the router first outlet path;

a bypass transfer for moving the media sheet away from the first entry path and toward a bypass outlet path, so as to bypass the first turning element, the bypass outlet path being adapted for outputting the media sheet from the router, the bypass outlet path being adapted for alignment with a bypass finisher inlet path;

a secondary diverter for selectively directing the media sheet onto a one of the first entry path and the bypass transfer;

a router second outlet path for outputting the media sheet from the router, the router second outlet path being disposed at ninety degrees to the router inlet path, the router second outlet path being opposed to the router first outlet path, the router second outlet path being adapted for alignment with a second finisher inlet path;

a second turning element mounted on a second axis disposed at forty-five degrees to the router inlet path and at ninety degrees to the first axis, the second turning element having a second entry path adapted for receiving the media sheet from the router inlet path, the second turning element being adapted for receiving the media sheet from the second entry path and directing the media sheet in a helical path around the second turning element and discharging the media sheet to the router second outlet path; and a primary diverter for selectively directing the media sheet onto a one of the first entry path and the second entry path;

wherein, the router is adapted for moving the media sheet from the digital printer through the router and selectively to the plurality of finishers at full process speed and while maintaining sheet orientation.

2. The media sheet router of claim 1, further comprising:

the first turning element includes a first turning roller mounted for rotation on the first axis, the first turning roller having an outer surface and a circumference, the first turning roller being adapted for directing the media sheet in a helical path around the outer surface of the first turning roller;

at least one first transfer belt juxtaposed with the first turning roller outer surface and extending in a helical path partway around the outer surface of the first turning roller and adapted for moving the media sheet along the first entry path and holding the media sheet against the first turning roller outer surface and moving the media sheet along the router first outlet path;

the second turning element includes a second turning roller mounted for rotation on the second axis, the second turning roller having an outer surface and a circumference, the second turning roller being adapted for directing the media sheet in a helical path around the outer surface of the second turning roller; and at least one second transfer belt juxtaposed with the second turning roller outer surface and extending in a helical path partway around the outer surface of the second turning roller and adapted for moving the media sheet along the second entry path and holding the media sheet against the second turning roller outer surface and moving the media sheet along the router second outlet path.

3. The media sheet router of claim 1, further comprising:

the first turning element includes a first turning cylinder mounted fixedly on the first axis, the first turning cylinder being hollow, and having a wall, an outer surface, a circumference, and an array of holes through the wall, the first turning cylinder being adapted for directing the media sheet in a helical path around the outer surface of the first turning cylinder;

the second turning element includes a second turning cylinder mounted fixedly on the second axis, the second turning cylinder being hollow, and having a wall, an outer surface, a circumference, and an array of holes through the wall, the second turning cylinder being adapted for directing the media sheet in a helical path around the outer surface of the second turning cylinder;

at least one first transfer belt juxtaposed with the first turning cylinder outer surface and extending in a helical path partway around the outer surface of the first turning cylinder, the first transfer belt being adapted for moving the media sheet along the first entry path and holding the media sheet against the first turning cylinder outer surface and moving the media sheet along the router first outlet path;

at least one second transfer belt juxtaposed with the second turning cylinder outer surface and extending in a helical path partway around the outer surface of the second turning cylinder, the second transfer belt being adapted for moving the media sheet along the second entry path and holding the media sheet against the second turning cylinder outer surface and moving the media sheet along the router second outlet path;

an antifriction coating including a layer of air between the first turning cylinder outer surface and the first transfer belt, and between the second turning cylinder outer surface and the second transfer belt; and a blower communicating with the first and second turning cylinders and with the holes, for supplying air to the antifriction coating.

4. The media sheet router of claim 1, further comprising:

the first turning element includes an arcuate first outer turning element concentrically surrounding an arcuate first inner turning element, the first inner and first outer elements extending in a semicircle about the first axis, the first inner and first outer elements extending between opposite ends and being spaced apart to define an arcuate first slot therebetween, the first slot being adapted for receiving the media sheet from the first entry path and directing the media sheet in a helical path through the first slot to the router first outlet path;

the second turning element includes an arcuate second outer turning element concentrically surrounding an arcuate second inner turning element, the second inner and second outer elements extending in a semicircle about the second axis, the second inner and second outer elements extending between opposite ends and being spaced apart to define an arcuate second slot therebetween, the second slot being adapted for receiving the media sheet from the second entry path and directing the media sheet in a helical path through the second slot to the router second outlet path;

a polymeric antifriction coating inside the first slot on the first inner and first outer elements and inside the second slot on the second inner and second outer elements;

at least one first transfer juxtaposed with the first slot, the first transfer being adapted for moving the media sheet along the first entry path; and at least one second transfer juxtaposed with the second slot, the second transfer being adapted for moving the media sheet along the second entry path.

5. A media sheet router for routing media sheets from a digital printer selectively to a plurality of finishers, for use in connection with a first finisher a second finisher and a bypass finisher, and a media sheet having a lead edge and a trail edge, the media sheet moving in a process direction along a process path, the router comprising:

a router inlet path for inputting the media sheet into the router, the router inlet path being adapted for alignment with a process outlet path of the printer;

a router first outlet path for outputting the media sheet from the router, the router first outlet path being disposed at ninety degrees to the router inlet path the router first outlet path being adapted for alignment with a first finisher inlet path;

a first turning roller mounted for rotation on a first axis disposed at forty-five degrees to the router inlet path, the first turning roller having an outer surface and a circumference, the first turning roller having a first entry path adapted for receiving the media sheet from the router inlet path, the first turning roller being adapted for receiving the media sheet from the first entry path and directing the media sheet in a helical path around the outer surface of the first turning roller and discharging the media sheet to the router first outlet path;

at least one first transfer belt juxtaposed with the first turning roller outer surface and extending in a helical path partway around the circumference of the first turning roller and adapted for moving the media sheet along the first entry path and holding the media sheet against the first turning roller outer surface and moving the media sheet along the router first outlet path;

a router second outlet path for outputting the media sheet from the router, the router second outlet path being disposed at ninety degrees to the router inlet path, the router second outlet path being opposed to the router first outlet path, the router second outlet path being adapted for alignment with a second finisher inlet path;

a second turning roller mounted for rotation on a second axis disposed at forty-five degrees to the router inlet path and at ninety degrees to the first axis, the second turning roller having an outer surface and a circumference, the second turning roller having a second entry path adapted for receiving the media sheet from the router inlet path, the second turning roller being adapted for receiving the media sheet from the second entry path and directing the media sheet in a helical path around the outer surface of the second turning roller and discharging the media sheet to the router second outlet path;

at least one second transfer belt juxtaposed with the second turning roller outer surface and extending in a helical path partway around the circumference of the second turning roller and adapted for moving the media sheet along the second entry path and holding the media sheet against the second turning roller outer surface and moving the media sheet along the router second outlet path;

a primary diverter for selectively directing the media sheet onto a one of the first entry path and the second entry path;

a bypass transfer for moving the media sheet away from the first entry path and toward a bypass outlet path, so as to bypass the first turning element, the bypass outlet path being adapted for outputting the media sheet from the router, the bypass outlet path being adapted for alignment with a bypass finisher inlet path; and a secondary diverter for selectively directing the media sheet onto a one of the first entry path and the bypass transfer; wherein the router is adapted for moving the media sheet from the digital printer through the router and selectively to the plurality of finishers at full process speed and while maintaining sheet orientation.

6. A method for routing media sheets from a digital printer to a plurality of finishers, for use in connection with a first finisher and a bypass finisher, the method comprising:

providing a router for routing the media sheets and aligning a process outlet path of the printer with a router inlet path;

moving the media sheet from the process outlet path of the printer into the router inlet path;

disposing a router first outlet path at ninety degrees to the router inlet path aligning the router first outlet path with a first finisher inlet path;

providing a first turning element on a first axis disposed at forty-five degrees to the router inlet path;

receiving the media sheet from the router inlet path and directing the media sheet in a helical path around the first turning element and to the router first outlet path when the first finisher is selected;

discharging the media sheet from the router along the router first outlet path and moving the media sheet into the first finisher inlet path;

providing a bypass transfer around the first turning element to a router bypass outlet path;

aligning the router bypass outlet path with a bypass finisher inlet path;

receiving the media sheet from the router inlet path and directing the media sheet to the router bypass outlet path when the bypass transfer is selected;

moving the media sheet from the router bypass outlet path into the bypass finisher inlet path;

moving the media sheet from the digital printer through the router and selectively to the plurality of finishers at full process speed and while maintaining sheet orientation;

disposing a router second outlet path at ninety degrees to the router inlet path and opposed to the router first outlet path;

aligning the router second outlet path with a second finisher inlet path;

providing a second turning element on a second axis disposed at forty-five degrees to the router inlet path and disposed at ninety degrees to the first turning element;

receiving the media sheet from the router inlet path and directing the media sheet in a helical path around the second turning element and to the router second outlet path when the second finisher is selected; and discharging the media sheet from the router along the router second outlet path and moving the media sheet into the second finisher inlet path.

7. The method of claim 6, further comprising;

providing a secondary diverter between the first turning element and the bypass transfer; and selectively directing the media sheet onto a one of the first turning element and the bypass transfer with the secondary diverter.

8. The method of claim 6, further comprising:

mounting a first turning roller for rotation on the first axis as the first turning element;

juxtaposing at least one first transfer belt with an outer surface of the first turning roller and extending the first transfer belt in a helical path partway around the outer surface of the first turning roller; and holding the media sheet against the first turning roller outer surface and directing the media sheet in a helical path around the first turning roller outer surface with the first transfer belt when the first finisher is selected.

9. The method of claim 6, further comprising;

providing a primary diverter between the first turning element and the second turning element; and selectively directing the media sheet onto a one of the first turning element and the second turning element with the primary diverter.

10. The method of claim 6, further comprising:

mounting a first turning roller for rotation on the first axis as the first turning element;

juxtaposing at least one first transfer belt with an outer surface of the first turning roller and extending the first transfer belt in a helical path partway around the outer surface of the first turning roller;

holding the media sheet against the first turning roller outer surface and directing the media sheet in a helical path around the first turning roller outer surface with the first transfer belt when the first finisher is selected;

mounting a second turning roller for rotation on the second axis as the second turning element;

juxtaposing at least one second transfer belt with an outer surface of the second turning roller and extending the second transfer belt in a helical path partway around the outer surface of the second turning roller; and holding the media sheet against the second turning roller outer surface and directing the media sheet in a helical path around the second turning roller outer surface with the second transfer belt when the second finisher is selected.

11. The method of claim 6, further comprising:

mounting a first turning cylinder fixedly on the first axis as the first turning element;

forming an array of holes through a wall of the first turning cylinder;

juxtaposing at least one first transfer belt with an outer surface of the first turning cylinder and extending the first transfer belt in a helical path partway around the outer surface of the first turning cylinder;

holding the media sheet against the first turning cylinder outer surface and directing the media sheet in a helical path around the first turning cylinder outer surface with the first transfer belt when the first finisher is selected; and forming an antifriction coating by blowing a layer of air between the first turning cylinder outer surface and the first transfer belt through the array of holes.

12. The method of claim 6, further comprising:

mounting a first turning cylinder fixedly on the first axis as the first turning element;

forming an array of holes through a wall of the first turning cylinder;

juxtaposing at least one first transfer belt with an outer surface of the first turning cylinder and extending the first transfer belt in a helical path partway around the outer surface of the first turning cylinder;

holding the media sheet against the first turning cylinder outer surface and directing the media sheet in a helical path around the first turning cylinder outer surface with the first transfer belt when the first finisher is selected;

forming an antifriction coating by blowing a layer of air between the first turning cylinder outer surface and the first transfer belt through the array of holes;

mounting a second turning cylinder fixedly on the second axis as the second turning element;

forming an array of holes through a wall of the second turning cylinder;

juxtaposing at least one second transfer belt with an outer surface of the second turning cylinder and extending the second transfer belt in a helical path partway around the outer surface of the second turning cylinder;

holding the media sheet against the second turning cylinder outer surface and directing the media sheet in a helical path around the second turning cylinder outer surface with the second transfer belt when the second finisher is selected; and forming an antifriction coating by blowing a layer of air between the second turning cylinder outer surface and the second transfer belt through the helical array of holes.

13. The method of claim 6, further comprising:

mounting an arcuate first outer turning element concentrically surrounding an arcuate first inner turning element on the first axis as the first turning element;

spacing the first inner and first outer elements apart to define an arcuate first slot therebetween;

forming a polymeric antifriction coating inside the first slot on the first inner and first outer elements; and receiving the media sheet in the first slot and directing the media sheet in a helical path through the first slot to the router first outlet path when the first finisher is selected.

14. The method of claim 6, further comprising:

mounting an arcuate first outer turning element concentrically surrounding an arcuate first inner turning element on the first axis as the first turning element;

spacing the first inner and first outer elements apart to define an arcuate first slot therebetween;

forming a polymeric antifriction coating inside the first slot on the first inner and first outer elements;

receiving the media sheet in the first slot and directing the media sheet in a helical path through the first slot to the router first outlet path when the first finisher is selected;

mounting an arcuate second outer turning element concentrically surrounding an arcuate second inner turning element on the second axis as the second turning element;

spacing the second inner and second outer elements apart to define an arcuate second slot therebetween;

forming a polymeric antifriction coating inside the second slot on the second inner and second outer elements; and receiving the media sheet in the second slot and directing the media sheet in a helical path through the second slot to the router second outlet path when the second finisher is selected.

* * * * *